US006418636B1

(12) United States Patent
Sonner

(10) Patent No.: US 6,418,636 B1
(45) Date of Patent: Jul. 16, 2002

(54) DRIER FOR A LACQUERING LINE

(75) Inventor: Harald Sonner, Sindelfingen (DE)

(73) Assignee: Eisermann Maschinenbau KG (DE)

( * ) Notice: Subject to any disclaimer, the term of this patent is extended or adjusted under 35 U.S.C. 154(b) by 0 days.

(21) Appl. No.: 09/633,747

(22) Filed: Aug. 7, 2000

(30) Foreign Application Priority Data

Aug. 11, 1999 (DE) ..... 199 37 901

(51) Int. Cl.[7] ..... F26B 21/00

(52) U.S. Cl. ..... 34/86; 34/570; 34/582; 34/589; 34/548

(58) Field of Search ..... 34/570, 571, 582, 34/589, 598, 236, 209, 210, 212, 219, 86

(56) References Cited

U.S. PATENT DOCUMENTS

| | | | | | |
|---|---|---|---|---|---|
| 2,202,995 | A | * | 6/1940 | Porwancher | 237/2 |
| 3,456,359 | A | * | 7/1969 | Smolski | 34/40 |
| 3,739,485 | A | * | 6/1973 | Tailor | 34/57 A |
| 4,092,100 | A | | 5/1978 | Phillips | |
| 4,253,825 | A | * | 3/1981 | Fasano | 432/149 |
| 4,475,294 | A | * | 10/1984 | Henricks | 34/79 |
| 4,475,295 | A | * | 10/1984 | Hussmann | 34/80 |
| 4,481,722 | A | * | 11/1984 | Guy et al. | 34/47 |
| 4,490,924 | A | * | 1/1985 | Lambert | 34/31 |
| 4,531,304 | A | * | 7/1985 | Wauhop et al. | 34/30 |
| 4,656,758 | A | * | 4/1987 | Nakayama | 34/54 |
| 4,662,840 | A | | 5/1987 | Ellison | |
| 5,309,827 | A | * | 5/1994 | Manser et al. | 99/468 |
| 5,341,580 | A | * | 8/1994 | Teal | 34/446 |
| 5,355,595 | A | * | 10/1994 | Koivuknnas et al. | 34/570 |
| 5,685,710 | A | * | 11/1997 | Martinez Sagrera et al. | 432/500 |
| 6,085,443 | A | * | 7/2000 | Hunter et al. | 34/535 |
| 6,159,294 | A | * | 12/2000 | Kuster et al. | 118/642 |

FOREIGN PATENT DOCUMENTS

| | | |
|---|---|---|
| EP | 0706021 A1 | 4/1996 |
| WO | WO 80/00183 | 6/1979 |

* cited by examiner

*Primary Examiner*—Ira S. Lazarus
*Assistant Examiner*—K. B. Rinehart
(74) *Attorney, Agent, or Firm*—Factor & Partners

(57) ABSTRACT

A drier for a lacquering line in a known manner comprises inside a drier housing a plurality of drier sections, in which heated circulating air is circulated with the aid of fans. Heating of the circulating air is effected with the aid of a heating unit, which is common to all drier sections, and a common fresh-air heat exchanger, which is disposed downstream of the heating unit and to which fresh air is supplied from the environment via a pressure regulator. The fresh air heated in said manner is directed via branch lines to the individual drier sections. The quantity of heated fresh air supplied and hence ultimately the temperature in the respective drier section is determined by control flaps in branch lines, which connect a common fresh-air distribution line to the respective sections. There may be connected in parallel to said control flaps, which convey hot fresh air, control flaps, which at least partially convey cool fresh air and are controlled in the opposite direction such that the total fresh air quantity flowing through a parallel pair of control flaps remains constant. The drier according to the invention is inexpensive and easy to maintain. Its style of construction means that in and around the drier housing there is a lot of space free, which in prior art was occupied by a plurality of heating units and heat exchangers associated with the latter.

2 Claims, 1 Drawing Sheet

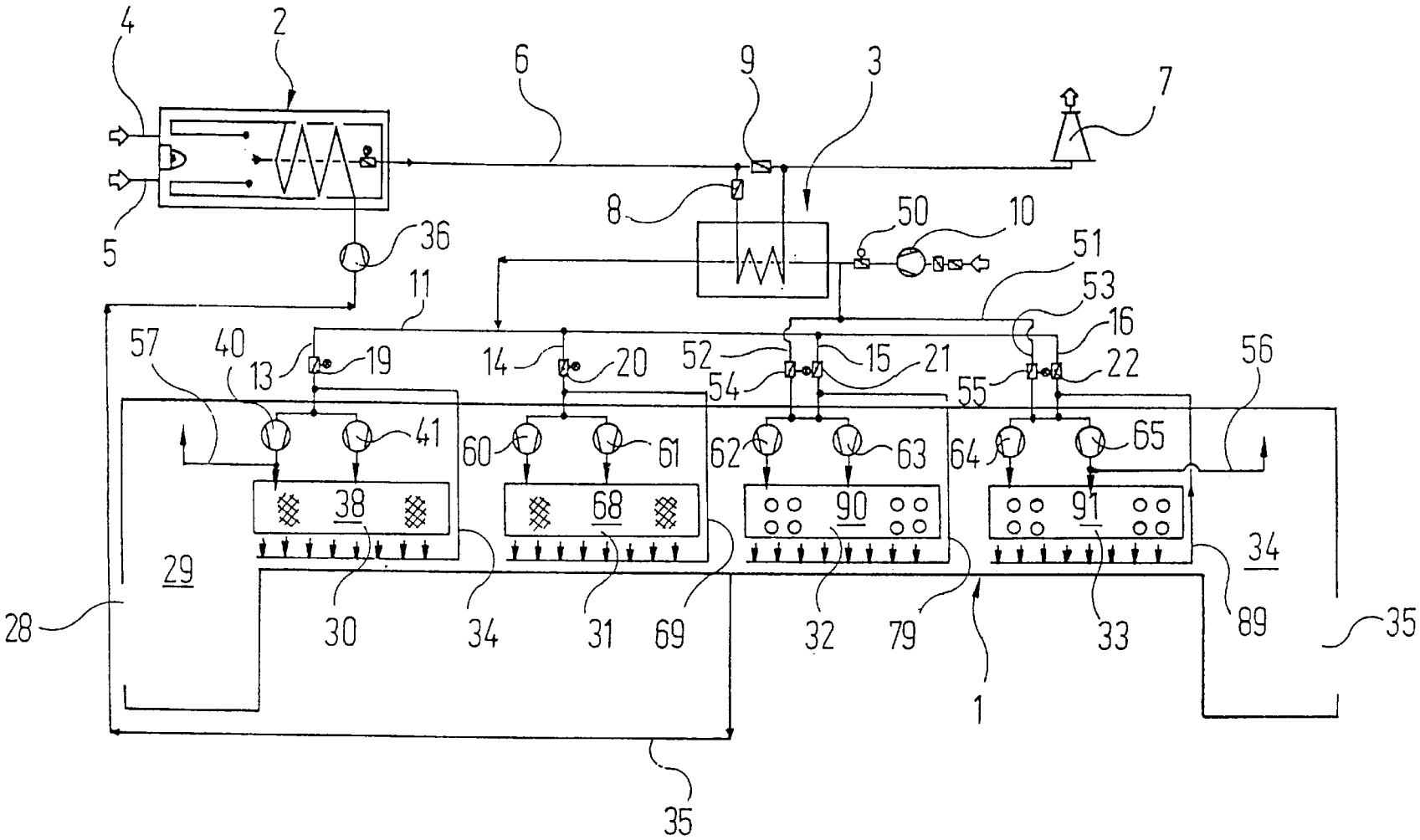
1
2
3
4
5
6
7
8
9
10
11
13
14
15
16
19
20
21
22
28
29
30
31
32
33
34
35
36
40
41
50
51
52
53
54
55
56
57
60
61
62
63
64
65
69
79
89
90
91
38
68

DRIER FOR A LACQUERING LINE

BACKGROUND OF THE INVENTION

The invention relates to a drier for a lacquering line for drying freshly lacquered articles.

In a specific, commercially known drier of having several drying, sections a separate heating unit is associated with each drier section. Each such heating unit generates its own heated primary gas flow, which is directed into the interior of the drier housing and conveyed there through a heat exchanger, which in turn is in thermal contact with the circulated air. Said style of construction is extremely expensive because it requires a plurality of heating units and heat exchangers.

Another drier is described in EP-A-0 706 021. Here, the hot primary gas flow generated by a central heating unit is conveyed through a double-walled line situated in the interior of the drier housing. Depending on the position of control flaps provided in sections, the hot primary gas is conveyed through the respective drier section inside the inner pipe and is therefore not available as a heat source for the circulated air or through the gap between the inner pipe and the outer pipe, which serves as a heat-exchanging surface for the air circulated in the relevant section. Said style of construction is also expensive, difficult to clean and maintain and takes up too much space on account of the hot primary gas line extending inside the drier housing. In the event of leakage from the primary gas pipe, primary gas may pass into the circulating air of the drier, which may cause lacquering defects. Furthermore, heat radiation and convection may not be adjusted independently of one another.

SUMMARY OF THE INVENTION

The object of the present invention is to refine a drier of the type defined initially in such a way that it is inexpensive to manufacture and easy to maintain.

The object is achieved by the drier of the invention. The drier comprises:

a) a drier housing;

b) a plurality of drier sections inside the drier housing, in each of which air may be circulated with the aid of at least one fan;

c) at least one heating unit, which generates a hot primary gas flow;

d) at least one heat exchanger, via which the air circulating in the drier sections is heated by the primary gas;

whereby e) the temperature of the air circulating in the various drier sections is individually adjustable.

f) for the plurality of drier sections a common heating unit and, downstream of the latter, a common fresh-air heat exchanger are provided;

g) the hot fresh air flow generated by the fresh-air heat exchanger is introducible through a distribution line and an appropriate number of branch lines into the various drier sections, wherein h) in each branch line an adjustable control flap is disposed.

The fact that only one heating unit and only one heat exchanger need be provided in a drier according to the invention already means that costs are considerably reduced. This is true even though the common heating unit and the common fresh-air heat exchanger have to be of a larger capacity than each of the heating units and heat exchangers used in prior art. Because of the heating of the circulated air by the heated fresh air supplied in metered quantities via the control flaps, very much fewer structural components are needed and take up space inside the drier housing. Owing to the reduced costs it is possible to provide the drier according to the invention with a higher number of drier sections, thereby enabling finer adjustment. of the object temperature curve. Whereas in prior art the circulation fans had to overcome the pressure drop at the heating units and heat exchangers, this is no longer necessary with the refinement of the drier according to the invention. The circulation fans may be of a smaller design and require less energy. Also, in heat-up mode less energy is consumed because there are fewer masses to heat up than in prior art.

In an advantageous embodiment of the invention, the heating unit is a regenerative thermal afterburning apparatus, to which the solvent-containing outgoing air from the drier housing is supplied. Thus, in a manner known as such, the solvent which has transferred to the circulating air is disposed of and at the same time at least some of the energy demand required for drying is covered.

Alternatively, however, the heating unit may be a gas burner or a steam generator.

BRIEF DESCRIPTION OF THE DRAWINGS

An embodiment of the invention is described in detail below with reference to the drawing; the single FIGURE is a diagrammatic view of a drier for a lacquering line.

DETAILED DESCRIPTION OF THE PREFERRED EMBODIMENTS

The drier illustrated in the drawing comprises, as its main components, a drier housing or drier tunnel 1 indicated in the drawing in vertical section, a thermal afterburning apparatus 2 as a primary central heating unit, and a fresh-air heat exchanger 3.

Compressed air for cooling measurement and control systems is supplied through the line 4 and natural gas is supplied through the line 5 to the thermal afterburning apparatus 2. A blower 36 via a line 35 extracts the solvent-containing outgoing air from the drier tunnel 1 and forces it into the afterburning apparatus 2. The mixture thus produced is burnt in the interior of the afterburning apparatus 2. The combustion gases flow through a line 6 to the serpentine heat-exchanging pipe of the fresh-air heat exchanger 3 and from there to a chimney 7. The combustion gases may alternatively—depending on the position of the throttle valves 8, 9—be fed directly to the chimney 7.

The combustion gases conveyed through the serpentine heat-exchanging pipe of the fresh-air heat exchanger 3 heat up fresh air taken in from the outside atmosphere by a blower 10. Via a pressure regulator 50, which ensures a constant volume rate of flow, some of the fresh air passes to the fresh-air heat exchanger 3. Said fresh air, after being heated up, is fed to a distribution line 11. In the illustrated embodiment the distribution line 11 extends outside of the drier tunnel 1, e.g. along the top thereof, but may alternatively be accommodated inside the housing of the drier tunnel 1.

The heated fresh air passes through branch lines 13, 14, 15, 16, which emanate from the distribution line 11 and in each of which a control flap 19, 20, 21, 22 is situated, into four sections 30, 31, 32, 33 in the interior of the drier tunnel 1.

A further portion of the fresh air taken in by the blower 10 and brought to volume constancy by the pressure regulator 50 is supplied to a second distribution line 51. Said fresh air is branched off upstream of the fresh-air heat exchanger 3, i.e. is not heated. Branch lines 52, 53 direct said cool fresh air via control flaps 54, 55 into the drier sections 32, 33. The control flaps 54, 55 are controlled in the opposite direction to the parallel control flaps regulating the supply of hot fresh air, such that the total air throughput through two parallel control flaps 21, 54 and 22, 55 leading into a specific drier section 32, 33 is constant.

The freshly lacquered articles to be dried, which in the drawing come from the right, move through an inlet opening 35 into the interior of the drier tunnel 1 and, there, initially into an inward transfer lock 34, in which they are not only preheated but also raised to a higher level. They are then moved, in the drawing, from right to left through the drier tunnel 1 and in the process run through four drier sections 33, 32, 31 and 30. The dried articles leave the drier tunnel 1 via an outward transfer lock 29, in which the articles are lowered again, and an outlet opening 28.

The tempering of both the inward transfer lock 34 and the outward transfer lock 29 is effected in each case from the adjacent drier section 33 or 31 via lines 56, 57. The adjustment of the temperature in the drier sections 30, 31, 32, 33 is effected by forced air circulation in the manner described in detail below.

In the last two drier sections 30, 31 run through, the following occurs: the hot fresh air introduced via the branch lines 13, 14 and through the control flaps 19, 20 into the interior of the drier sections 30, 31 is supplied to the suction side of in each case two fans 40, 41 and 60, 61. The latter are used as circulation fans and convey the heated fresh air via a filter 38 and 68 onto the article to be dried. The air enriched with solvent is sucked in the bottom region of the drier tunnel 1 and returned via a recirculation line 34 and 69 to the suction side of the fans 40, 41 and 60, 61.

Temperature sensors disposed at a suitable point in the region of the drier sections 30, 31 monitor the temperature there. If the value of said temperature drops below a preset value, control electronics act upon the servomotor of the appropriate control flap 19 or 20 and open the latter (to a greater extent) so that (more) heated fresh air may be taken in by the fans 40, 41 or 60, 61 and introduced into the circulating air circuit flowing through the recirculation line 34 or 69. Conversely, if the temperature sensor detects too high a temperature, the same control loop closes the respective control flap 19 or 20 in the branch line 13 or 14 (to a greater extent) so that no heated fresh air or less heated fresh air may pass into the circulating air circuit.

In the illustrated embodiment, in the last drier sections 30, 31 to be run through the circulated air is fed in each case via the filters 38, 68 to the articles to be dried, while in the first drier sections 32 and 33 to be run through the circulating air is directed by nozzles 90, 91 towards the articles to be dried. In the last-mentioned drier sections 32, 33 the adjustment of the respective setpoint temperatures, as far as the regulation of the supply of heated fresh air via the branch lines 15, 16 and the control flaps 21 and 22 is concerned, occurs in the same manner as was described above for the drier sections 30, 31. The only difference is that, by adding a suitable quantity of cool fresh air through the branch lines 52 and 53 as well as through the control flaps 54, 55, the total fresh air introduced into the drier sections 32, 33 is held constant. The purpose of said measure is to enable the overall "air balance" of the drier to be maintained even when the demand for heat supply into the drier fluctuates widely. Since a wide fluctuation in the supplied heat is normally to be expected only in the drier sections 32, 33 adjacent to the inward transfer lock 34, it is sufficient to add cool fresh air only in said drier sections 31, 32.

What is claimed is:

1. A drier for a lacquering line comprising:

a) a drier housing;

b) a plurality of drier sections inside the drier housing, in each of which air may be circulated with the aid of at least one fan;

c) at least one heating unit, which generates a hot primary gas flow;

d) at least one heat exchanger, via which the air circulating in the drier sections is heated by the primary gas;

whereby e) the temperature of the air circulating in the various drier sections is individually adjustable;

wherein f) for the plurality of the drier sections a common heating unit and, downstream of the latter, a common fresh-air heat exchanger are provided, wherein the fresh air supplied to the fresh-air heat exchanger may be taken in from the environment by means of a blower;

g) a pressure regulator disposed downstream of the blower;

h) the hot fresh air flow generated by the fresh-air heat exchanger is introducible through a distribution line and an appropriate number of branch lines into the various drier sections, whereby i) in each branch line an adjustable control flap is disposed.

2. A drier for a lacquering line comprising:

a) a drier housing;

b) a plurality of drier sections inside the drier housing, in each of which air may be circulated with the aid of at least one fan;

c) at least one heating unit which generates a hot primary gas flow;

d) at least one heat exchanger, via which the air circulating in the drier sections is heated by the primary gas;

whereby e) the temperature of the air circulating in the various drier sections is individually adjustable;

wherein f) for the plurality of the drier sections a common heating unit and, downstream of the latter, a common fresh-air heat exchanger are provided;

g) the hot fresh air flow generated by the fresh-air heat exchanger is introducible through a distribution line and an appropriate number of branch lines into the various drier sections;

wherein h) in each branch line an adjustable control flap is disposed, wherein connected in parallel to the control flap is a second control flap, via which cool fresh air is introducible into the respective drier section and which is controlled in the opposite direction such that the total air quantity flowing through the parallel control flaps remains constant.

* * * * *